US008721108B2

(12) United States Patent
Lee

(10) Patent No.: US 8,721,108 B2
(45) Date of Patent: May 13, 2014

(54) LED STREET LIGHT

(75) Inventor: Chung-En Lee, Taipei (TW)

(73) Assignee: Lite-On Technology Corp., Taipei (TW)

( * ) Notice: Subject to any disclaimer, the term of this patent is extended or adjusted under 35 U.S.C. 154(b) by 438 days.

(21) Appl. No.: 13/157,415

(22) Filed: Jun. 10, 2011

(65) Prior Publication Data

US 2011/0305019 A1 Dec. 15, 2011

Related U.S. Application Data

(60) Provisional application No. 61/353,749, filed on Jun. 11, 2010.

(51) Int. Cl.
*E01F 9/00* (2006.01)

(52) U.S. Cl.
USPC ..... 362/153.1; 362/145; 362/151; 362/152; 362/153

(58) Field of Classification Search
USPC ..... 362/145, 151–153.1
See application file for complete search history.

(56) References Cited

U.S. PATENT DOCUMENTS

2009/0316403 A1* 12/2009 Zhang et al. ..... 362/249.01
2009/0323324 A1* 12/2009 Liu ..... 362/234
2009/0323343 A1* 12/2009 Wang ..... 362/249.11
2010/0277920 A1* 11/2010 Choi et al. ..... 362/249.06
2011/0032696 A1* 2/2011 Kim et al. ..... 362/184
2011/0219650 A1* 9/2011 Wright et al. ..... 362/249.02

* cited by examiner

*Primary Examiner* — William Carter
(74) *Attorney, Agent, or Firm* — Rosenberg, Klein & Lee

(57) ABSTRACT

An LED street light includes a central housing portion having two spaced-apart sidewalls, and two lateral housing portions disposed respectively on two opposite longitudinal sides of the central housing portion. Each lateral housing portion includes a first plate fixed to a respective sidewall and having a first plate opening, a second plate connected to the first plate, a curved plate connected to the second plate, and a reflection layer disposed on the curved plate and facing one of the sidewalls. The first plate and the curved plate of each lateral housing portion have bottom ends defining a bottom opening. A plurality of light-emitting modules are disposed on each sidewall. Each light-emitting module includes at least one LED element, and extends into one of the lateral housing portions through the first plate opening. The reflection layer reflects the light emitted by the LED element toward the bottom opening.

7 Claims, 7 Drawing Sheets

LED STREET LIGHT

CROSS REFERENCE TO RELATED APPLICATION

This application claims priority of U.S. Provisional Application No. 61/353,749, filed on Jun. 11, 2010.

BACKGROUND OF THE INVENTION

1. Field of the Invention

The invention relates to a street light, and more particularly to an LED street light.

2. Description of the Related Art

Because light-emitting diodes (LED) have many advantages over some other types of lighting, such as reduced power consumption, long service life, environmental conservation, etc., they are increasingly being applied to a variety of lighting fields. For example, the light-emitting diodes are used in street lights. However, since the light-emitting effect is high, a large amount of heat is also produced. Hence, the area of improvement that the present invention focuses on is that related to resolving problems of heat dissipation.

SUMMARY OF THE INVENTION

Therefore, the object of this invention is to provide an LED street light having improved heat dissipation.

According to one aspect of this invention, an LED street light comprises a housing unit and at least one light-emitting module. The housing unit includes a central housing portion made of a heat-conductive material, and two lateral housing portions disposed respectively on two opposite longitudinal sides of the central housing portion. The central housing portion includes two spaced-apart sidewalls. Each lateral housing portion includes a first plate fixed to a respective one of the sidewalls, a second plate connected to and extending upwardly and slantingly from the first plate, a curved plate connected to and extending downwardly from the second plate, and a reflection layer disposed on the curved plate and facing one of the sidewalls. The first plate and the curved plate of each of the lateral housing portions have bottom ends defining a bottom opening. The first plate has a first plate opening. The light-emitting modules are disposed on each of the sidewalls. Each of the light-emitting modules includes at least one LED element. Each of the light-emitting modules extend into one of the lateral housing portions through the first plate opening. The reflection layer reflects the light emitted by the LED element toward the bottom opening.

The central housing portion further includes a top wall connected between the sidewalls, and a plurality of heat-dissipating fins connected integrally to and extending upwardly from the top wall.

The top wall has a vertical curved cross section. The heat-dissipating fins extend radially from the top wall.

The second plate of each of the lateral housing portions is in contact with an outermost one of the heat-dissipating fins.

The first plate and the curved plate of each of the lateral housing portions have bottom ends flush with bottom ends of the sidewalls.

The LED street light further comprises two optical glasses each connected to the bottom ends of the curved plate and the first plate of the respective one of the lateral housing portions and covering the bottom opening in the respective one of the lateral housing portions.

The housing unit further includes a connection member for insertion of a light post. The central housing portion is connected to the connection member.

According to another aspect of this invention, an LED street light comprises a housing unit including a lower housing member and an upper housing member. The lower housing member is formed with a receiving portion for receiving an electronic module, and a frame portion connected to the receiving portion and having a frame opening. The upper housing member is made of a heat-conductive material, and is supported by the lower housing member. The upper housing member includes a first top plate corresponding in position to the frame portion, and a second top plate connected to the first top plate and corresponding in position to the receiving portion. The light-emitting module is disposed on the first top plate, and includes an LED element facing the frame portion.

The upper housing member is connected pivotally and openably to the lower housing member.

The housing unit further includes an engaging element disposed on one of the upper and lower housing members. The engaging element is engageable with one of the upper and lower housing members when the upper housing member closes the lower housing member.

The LED street light further comprises an optical glass disposed on the frame portion and covering the frame opening.

The first top plate has a heat-conductive material and a heat-conductive area, both of which are designed for conducting heat generated by the light-emitting module along the first top plate.

According to still another aspect of this invention, an LED street light comprises a housing unit and a plurality of light-emitting modules. The housing unit includes an upper housing member. The upper housing member includes a central housing portion made of a heat-conductive material, and two lateral housing portions disposed respectively on left and right sides of the central housing portion. The central housing portion includes two spaced-apart sidewalls. Each of the lateral housing portions includes a curved plate, and a reflection layer disposed on the curved plate and facing one of the sidewalls. The curved plate is connected to and extends downwardly from one of the sidewalls. Each of the lateral housing portions is formed with a bottom opening. The curved plate further has an outer surface opposite to the reflection layer. The outer surface is formed with a plurality of spaced-apart grooves. The light-emitting modules are disposed on each of the sidewalls. Each of the light-emitting modules includes at least one LED element. The reflection layer reflects the light emitted by the LED element toward the bottom opening. The housing unit further includes a lower housing member connected to the upper housing member and having a lower housing opening aligning with the bottom openings in the lateral housing portions, and an optical glass covering the lower housing opening.

The central housing portion further includes a bottom wall connected between the sidewalls and cooperating with the sidewalls to define a channel for communication with ambient air.

The central housing portion and the lateral housing portions are connected integrally as one piece.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
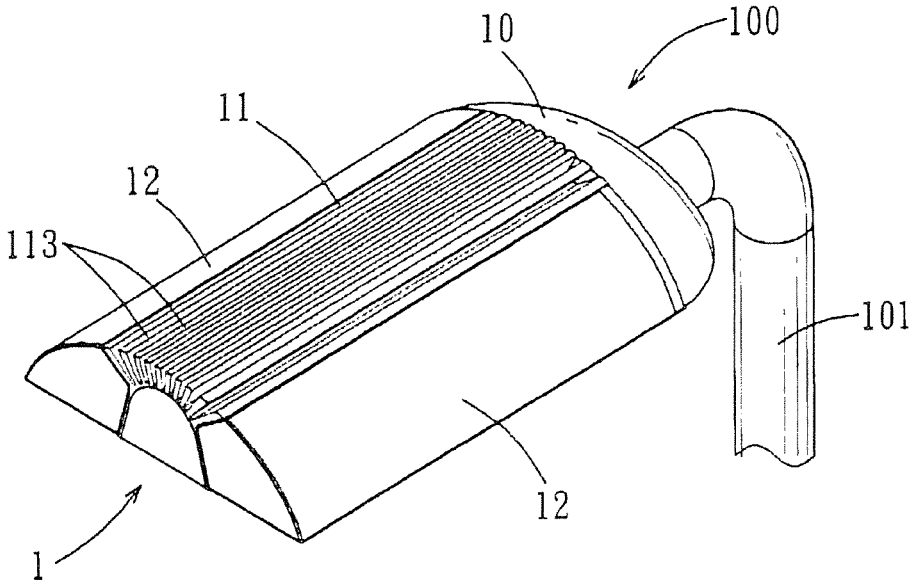
FIG. 1 is a perspective view of an LED street light according to the first preferred embodiment of the present invention.
Figure 2:
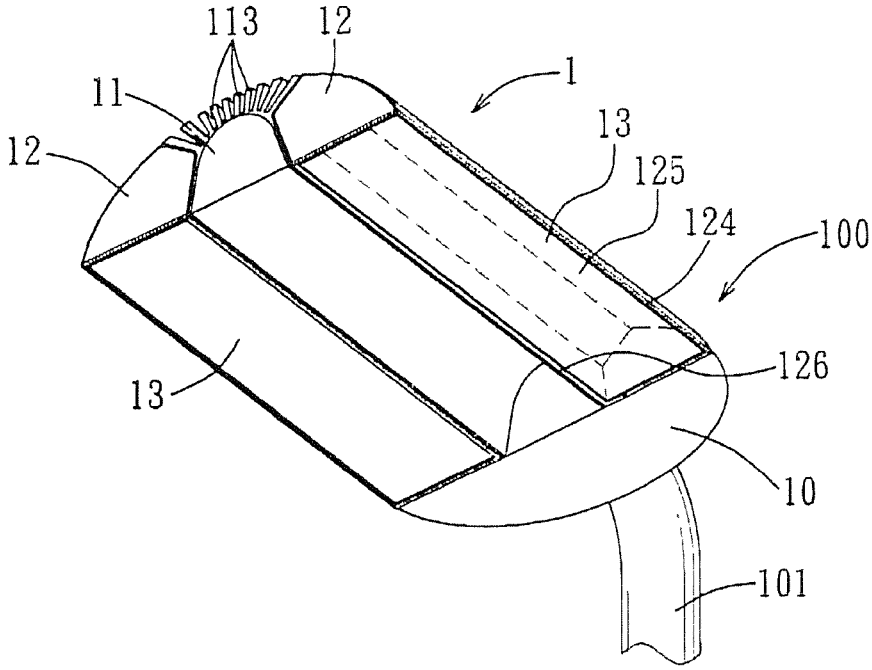
FIG. 2 is a bottom perspective view of the first preferred embodiment.
Figure 3:
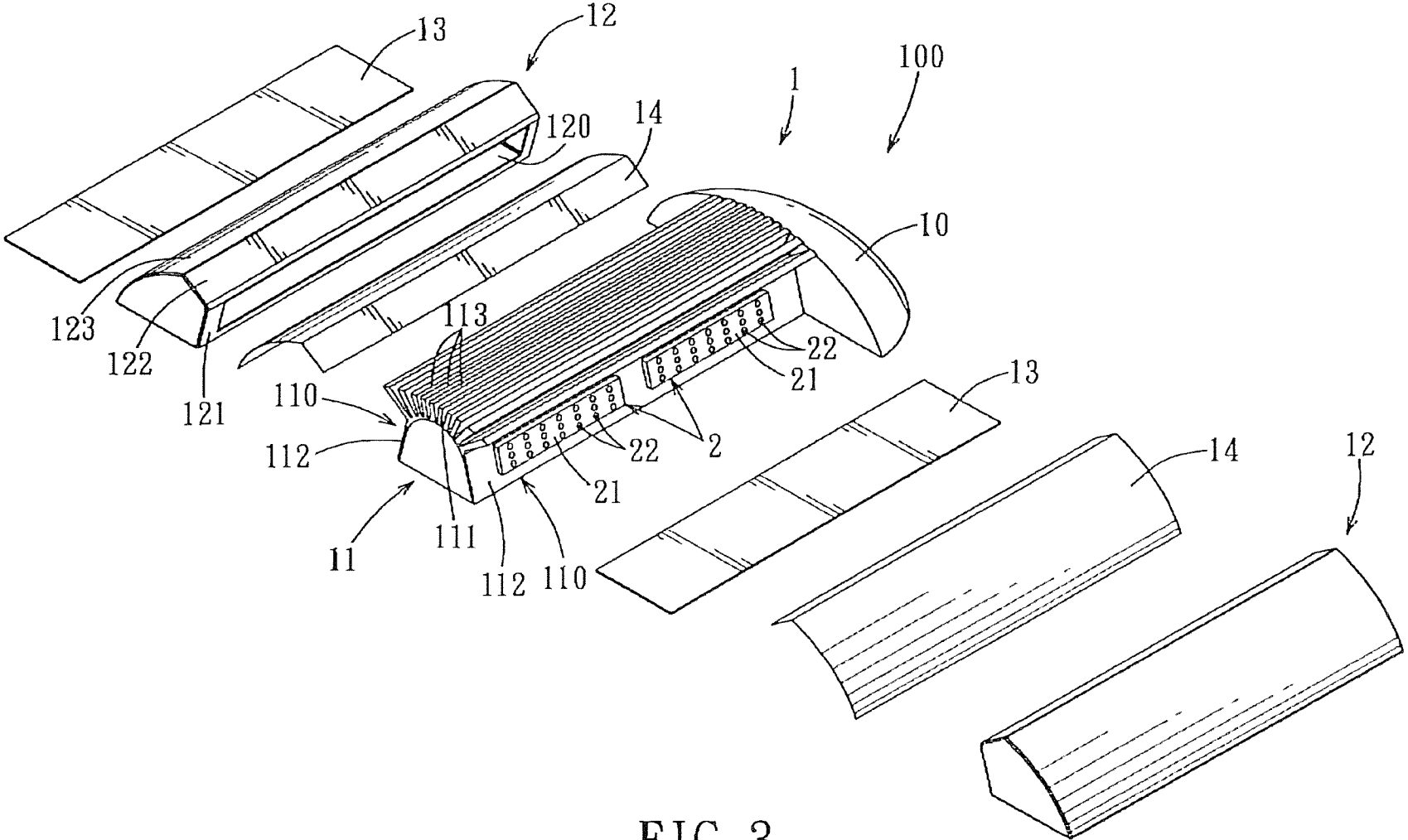
FIG. 3 is an exploded perspective view of the first preferred embodiment.
Figure 4:
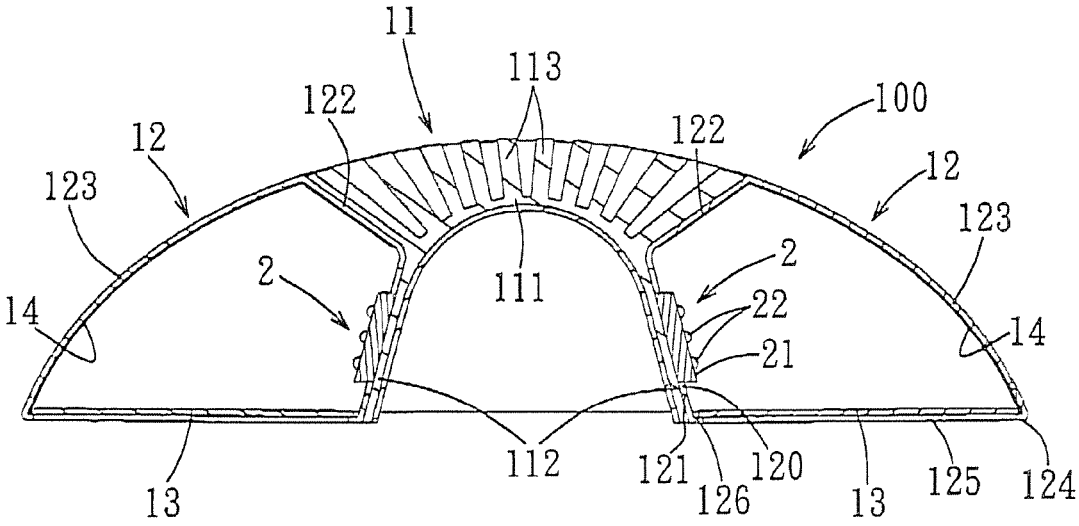
FIG. 4 is a sectional view of the first preferred embodiment in an assembled state.
Figure 5:
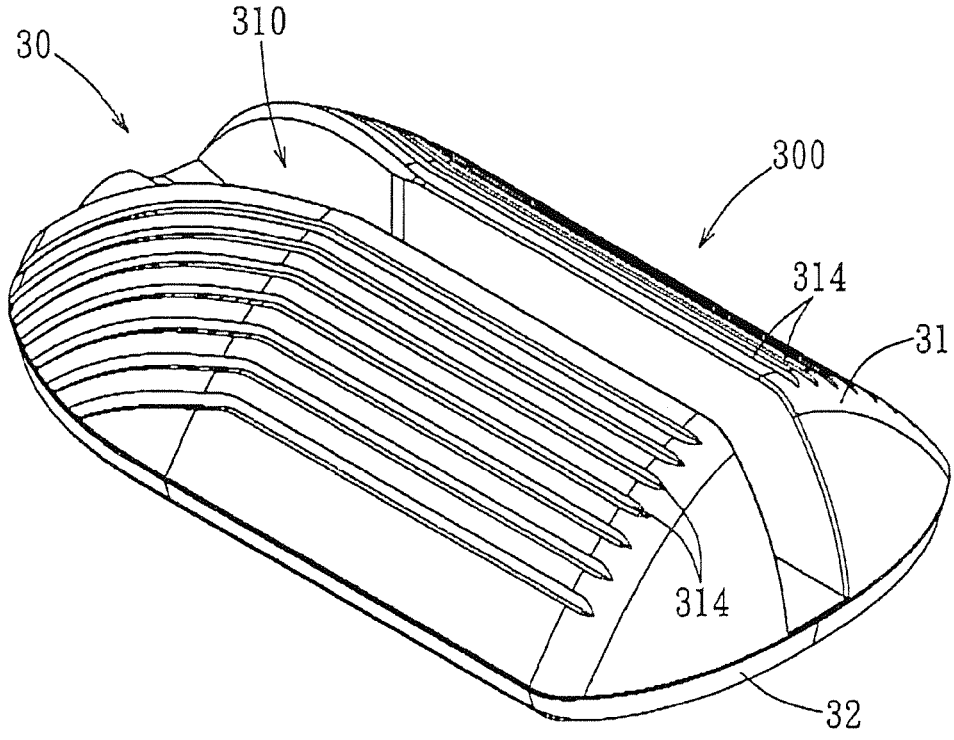
FIG. 5 is a perspective view of an LED street light according to the second preferred embodiment of the present invention.
Figure 6:
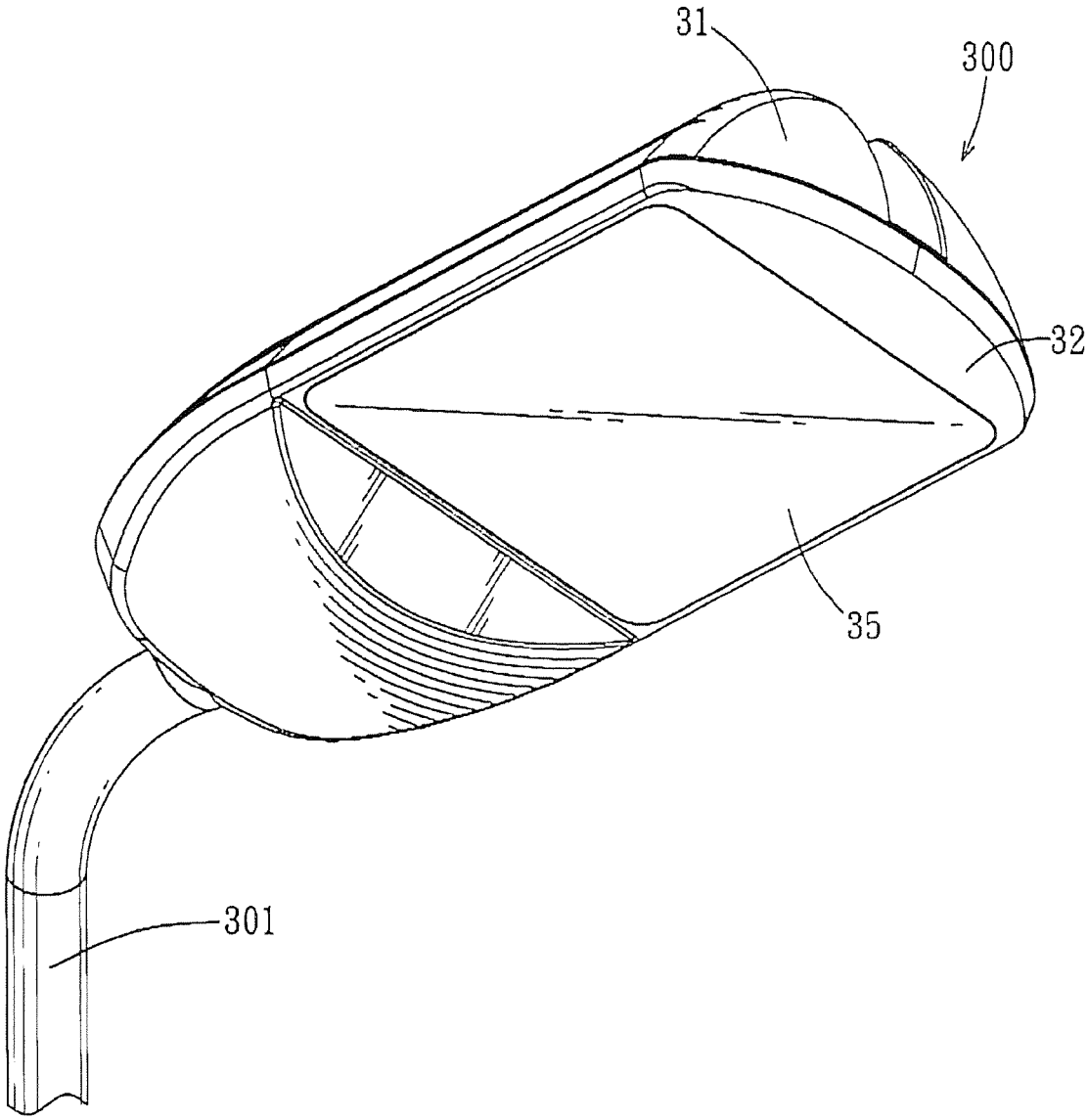
FIG. 6 is a bottom perspective view of the second preferred embodiment.
Figure 7:
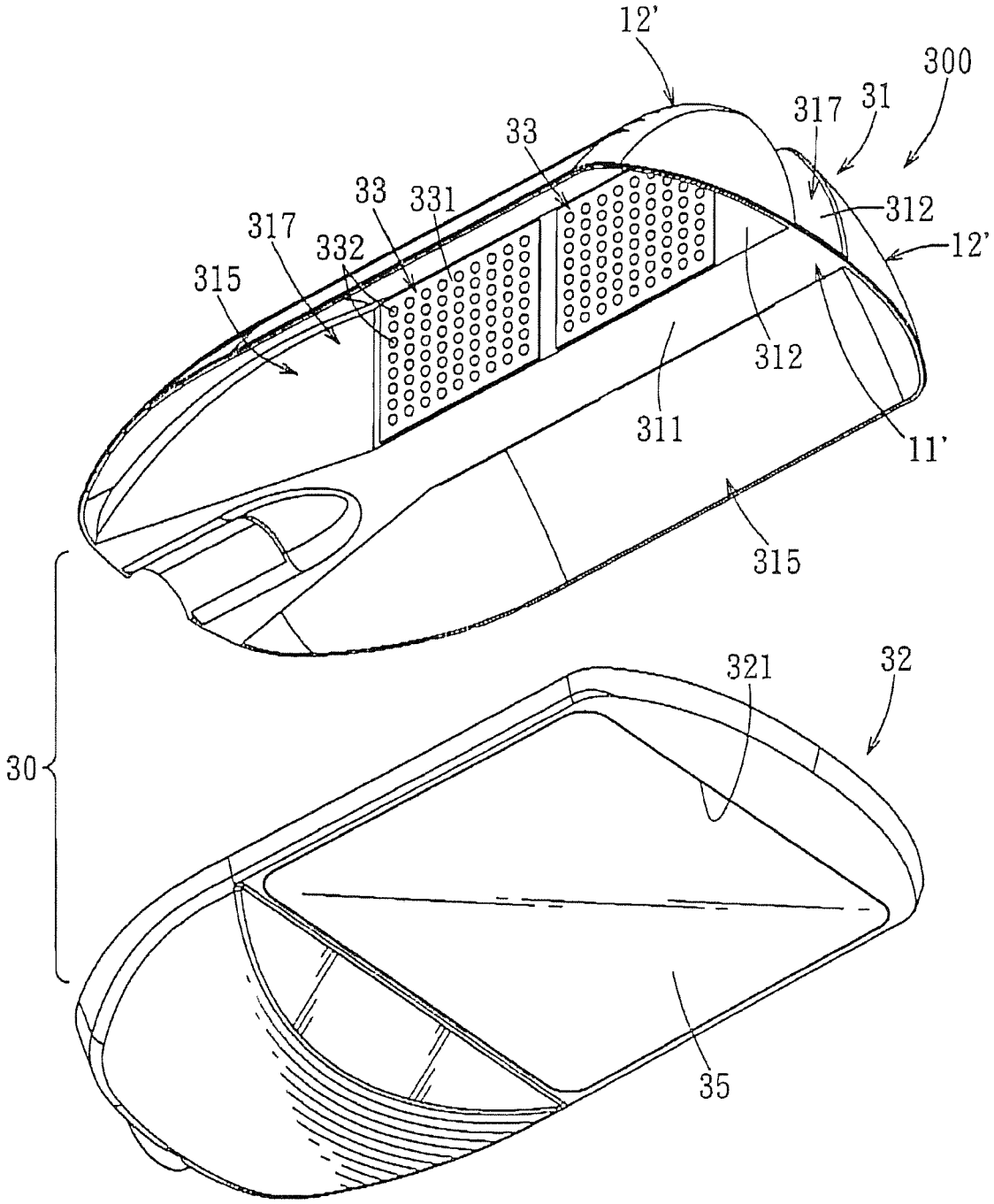
FIG. 7 is an exploded perspective view of the second preferred embodiment.
Figure 8:
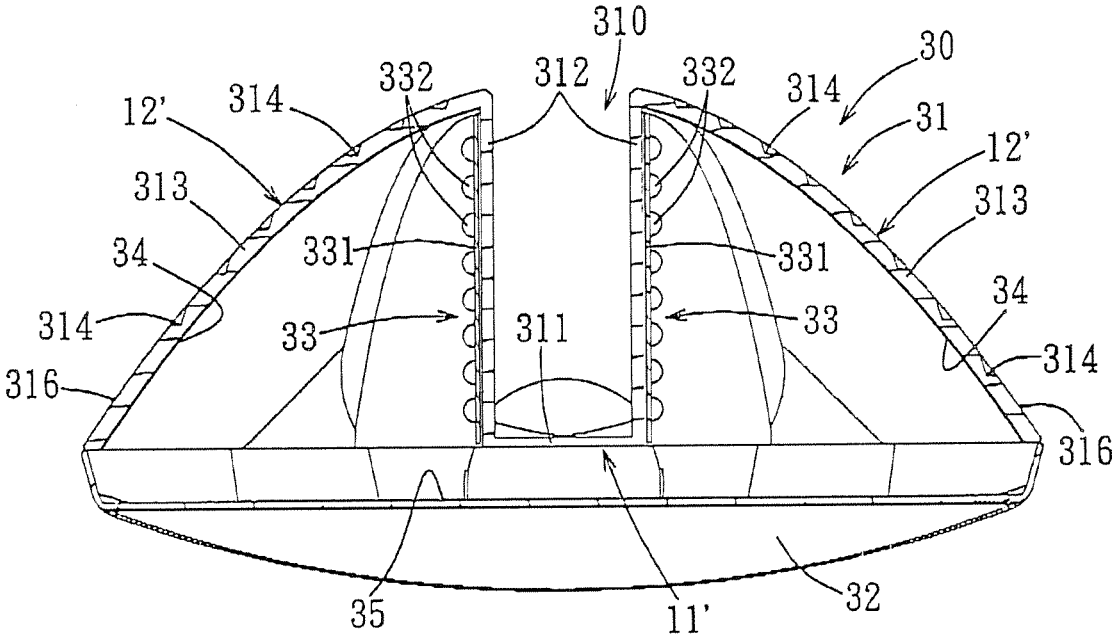
FIG. 8 is a sectional view of the second preferred embodiment in an assembled state.

The above-mentioned and other technical contents, features, and effects of this invention will be clearly presented from the following detailed description of the three preferred embodiments in coordination with the reference drawings.

Before the present invention is described in greater detail, it should be noted that like elements are denoted by the same reference numerals throughout the disclosure.

Referring to FIGS. 1 to 4, an LED street light 100 according to the first preferred embodiment of this invention comprises a housing unit 1, and a plurality of light-emitting modules 2 disposed in the housing unit 1. The housing unit 1 includes a connection member 10 for insertion of a light post 101, a central housing portion 11, two lateral housing portions 12, and two optical glasses 13.

The central housing portion 11 has a substantially elongated housing structure with a bottom opening, and includes two spaced-apart sidewalls 112, a top wall 111 connected between the sidewalls 112, and a plurality of heat-dissipating fins 113. The top wall 111 has a vertical cross section that is curve-shaped with two opposite ends facing downward. The sidewalls 112 extend downward and gradually slant outward from two opposite longitudinal ends of the top wall 111, respectively, and are spaced apart in a left-right manner. The sidewalls 112 respectively define two longitudinal sides 110 of the central housing portion 11. The top wall 111 and the sidewalls 112 are connected to form a substantially inverted U-shaped body. A space between the two sidewalls 112 is used for receiving electronic components (such as drive circuits) which are connected electrically to the light-emitting modules 2. The heat-dissipating fins 113 are connected integrally as one piece with the top wall 111, are angularly spaced apart from each other (see FIG. 4), and extend along the length of the top wall 111. Further, the heat-dissipating fins 113 extend radially and upwardly from the top wall 111. A transverse end that is transverse to the longitudinal sides 110 of the central housing portion 11 is connected fixedly to the connection member 10. The central housing portion 11 is made of a heat-conductive material. Preferably, the central housing portion 11 is made of aluminum (e.g., by aluminum extrusion), but may also be made of other conductive materials. The material of the central housing portion 11 may be similar to that of the connection member 10 or the light post 101 of the street light 100 so as to prevent existence of heat conduction barrier due to difference in materials.

The light-emitting modules 2 are disposed on outer wall faces of each sidewall 112 of the central housing portion 11. Each light-emitting module 2 includes a circuit board 21, and a plurality of LED elements 22 (may be LED package or LED chip) disposed on the circuit board 21.

The lateral housing portions 12 are disposed respectively on the longitudinal sides 110 of the central housing portion 11. Each of the lateral housing portions 12 also has a substantially elongated hollow body, and includes a first plate 121, a second plate 122 connected to the first plate 121, a curved plate 123 connected to the second plate 122, a bottom peripheral flange 124, and a reflection layer 14. The first plate 121 extends slantingly, and abuts against the outer wall face of the respective sidewall 112. The first plate 121 has a substantially rectangular shape, and a first plate opening 120 that extends along the length thereof. When the first plates 121 of the lateral housing portions 12 are fixed respectively to the outer wall faces of the sidewalls 112, a major portion (especially the region used for disposal of the light-emitting modules 2) of the outer wall face of each sidewall 112 is exposed via the first plate opening 120. That is, when the lateral housing portions 12 are connected to the central housing portion 11, the light-emitting modules 2 extend into the respective lateral housing portion 12 through the first plate opening 120.

The second plate 122 of each lateral housing portion 12 extends upwardly and slantingly from a top end of the first plate 121, and cooperates with the first plate 121 to form therebetween an included angle that is the same as that formed by one of the sidewalls 112 and a respective outermost one of the heat-dissipating fins 113. Hence, when the first plate 121 abuts fixedly against the respective sidewall 112, the second plate 122 can also abut fixedly against an outer face of the respective outermost one of the heat-dissipating fins 113. That is, when the lateral housing portions 12 are connected to the central housing portion 11, the first and second plates 121, 122 of each lateral housing portion 12 abut fixedly and respectively against one of the sidewall 112 and the respective outermost one of the heat-dissipating fins 113.

The curved plate 123 of each lateral housing portion 12 extends downward from one end of the second plate 122 that is distal from the first plate 121. The first plate 121 and the curved plate 123 have bottom ends 124, 126 defining a bottom opening 125 and flush with bottom ends of the respective sidewall 112. When the lateral housing portions 12 are connected fixedly to the central housing portion 11, an inner surface of the curved plate 123 substantially faces the outer wall face of the respective sidewall 112 that is exposed via the first plate opening 120.

The reflection layer 14 of each lateral housing portion 12 is disposed on inner surfaces of the curved plate 123 and the second plate 122 of the respective lateral housing portion 12. Each reflection layer 14 may be formed by coating a reflective material on the inner surfaces of the second plate 122 and the curved plate 123 of the respective lateral housing portion 12, or may be configured as a plate structure that is adhered to the inner surfaces of the second plate 122 and the curved plate 123 of the respective lateral housing portion 12.

The two optical glasses 13 are disposed respectively in the lateral housing portions 12, and respectively cover the bottom openings 125 in the lateral housing portions 12. Each optical glass 13 is substantially flat, and is supported by the bottom ends 124, 126 of the first plate 121 and the curved plate 123 of the respective lateral housing portion 12. Thus, each lateral housing portion 12 has a longitudinal hollow housing structure having a bottom portion and one side formed with the first plate opening 120.

When the light-emitting modules 2 are in operation, because of the slanting configuration of the sidewalls 112, light emitted by the LED elements 22 at each side wall 112 project toward the curved plate 123, and are reflected by the reflection layer 14. The reflection layer 14 reflects the light emitted by the LED elements 22 toward the bottom opening 125 passing through the optical glass 13 and out of the respective lateral housing portion 12.

In this embodiment, since the light-emitting modules 2 are disposed on and in direct contact with the two sidewalls 112 of the central housing portion 11, when heat is generated during operation of the light-emitting modules 2, heat is transmitted upwardly and directly to the top wall 111 through the sidewalls 112, and is dissipated through the heat-dissipating fins 113. Further, since the second plates 122 of the lateral housing portions 12 abut respectively against the two outermost ones of the heat-dissipating fins 113, heat transmitted by the light-emitting modules 2 to the central housing portion 11 can also be dissipated through the two lateral housing portions 12. Moreover, since the heat-dissipating fins 113 are connected integrally as one piece with the central housing portion 11, in comparison with the outer casing and the heat-dissipating fins of the conventional street light which are two independent components and require assembly, assembly costs of the present invention can be minimized.

FIGS. 5 to 8 illustrate an LED street light 300 according to the second preferred embodiment of this invention. As compared to the first preferred embodiment, the central housing portion 11' and the lateral housing portions 12' of the housing unit 30 of this embodiment are connected integrally as one piece, and form an upper housing member 31 of the housing unit 30. The central housing portion 11' includes two sidewalls 312 spaced apart from each other in a left-right manner, and a bottom wall 311 connected between the sidewalls 312. The sidewalls 312 and the bottom wall 311 cooperatively define a channel 310 that is opened at front, rear, and top ends. The sidewalls 312 similarly define the two longitudinal sides 317 of the central housing portion 11'. Each lateral housing portion 12' includes a curved plate 313 connected to and extending downwardly and curvedly from a top end of a respective sidewall 312. The curved plate 313 and the respective sidewall 312 have bottom ends defining a bottom opening 315. The upper housing member 31 is made of a heat-conductive material, and has a vertical cross section that is perpendicular to the length thereof and that has a substantially inverted W-shape (see FIG. 8).

Reflection layers 34 are disposed respectively on inner surfaces of the curved plates 313, and face the sidewalls 312. Each curved plate 313 further has an outer surface 316 opposite to the inner surface, and a plurality of spaced-apart elongated grooves 314 formed in the outer surface 316 and extending along the length of the curved plate 313. The indented shapes and the extending direction of the grooves 314 are not limited to the aforesaid disclosures. As long as the contact area of the outer surface 316 with the ambient atmosphere is enhanced, any shape and extending direction of the grooves 314 are acceptable.

Further, the housing unit 30 of the second preferred embodiment further includes a lower housing member 32 connected to the upper housing member 31 and having a lower housing opening 321. An optical glass 35 is connected to the lower housing member 32, and covers the lower housing opening 321. The light post 301 is inserted between a junction of the upper and lower housing members 31, 32.

The light-emitting modules 33 are disposed on each of the sidewalls 312. Each light-emitting module 33 includes a circuit board 331, and a plurality of LED elements 332 disposed on the circuit board 331 and facing the curved plate 313 of the respective lateral housing portion 12'. Further, the light-emitting modules 33 are disposed above the lower housing opening 321.

In this second embodiment, through the formation of the channel 310 in the upper housing member 31, heat transmitted to the sidewalls 312 from the light-emitting modules 33 can be directly dissipated through the channel 310, thereby enhancing the heat dissipating effect of the upper housing member 31. Further, since the two lateral housing portions 12' are connected integrally as one piece with the central housing portion 11', heat from the two sidewalls 312 can be quickly transmitted to and dissipated from the curved plates 313 of the lateral housing portions 12'. Moreover, through the formation of the grooves 314 in the outer surface of each curved plate 313, the contact area between the curved plate 313 and the ambient atmosphere can also be increased, thereby enhancing the heat dissipating effect of the upper housing member 31.

Figure 9:
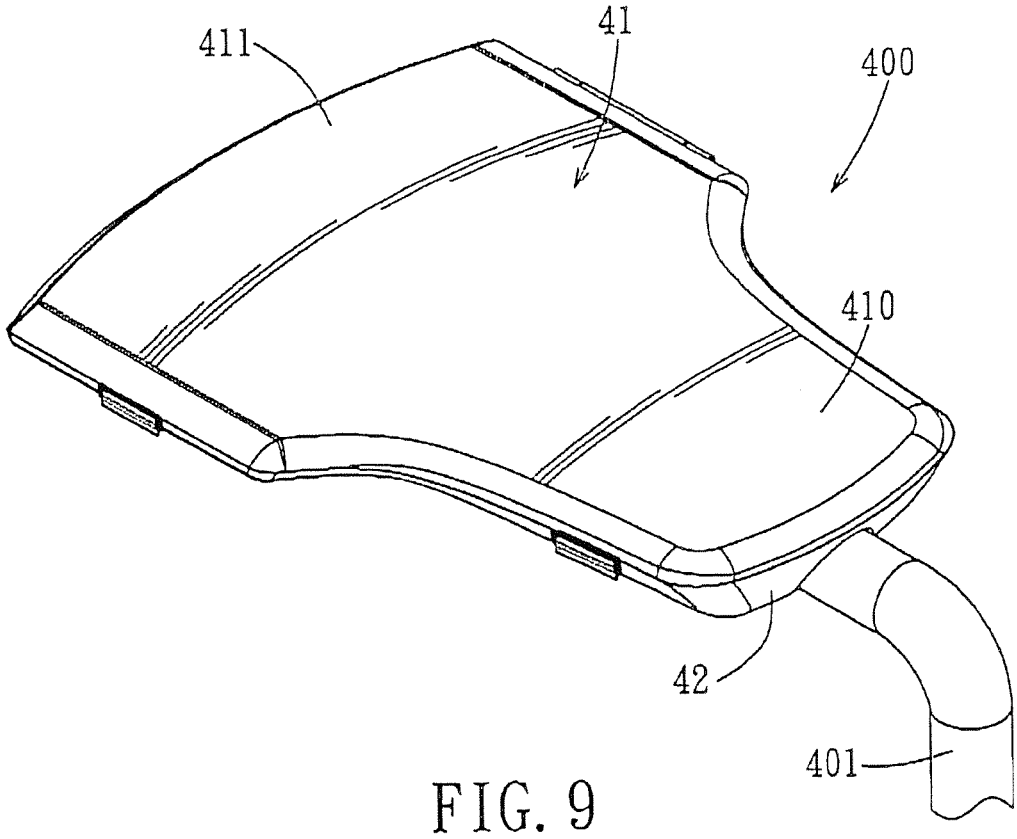
FIG. 9 is a perspective view of an LED street light according to the third preferred embodiment of the present invention.
Figure 10:
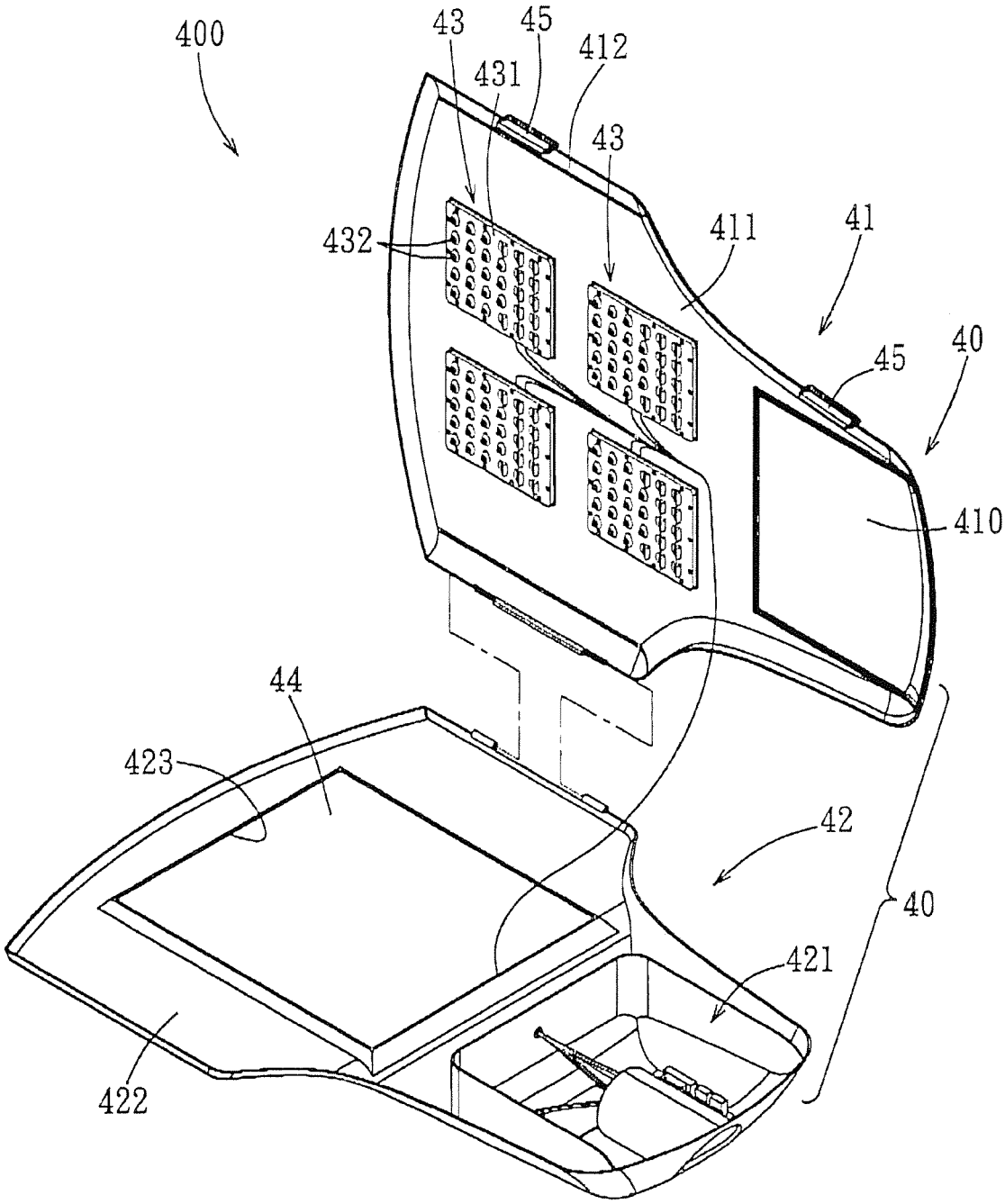
FIG. 10 is an exploded perspective view of the third preferred embodiment.

Referring to FIGS. 9 and 10, an LED street light 400 according to the third preferred embodiment of this invention includes a housing unit 40 and a plurality of light-emitting modules 43. The housing unit 40 includes upper and lower housing members 41, 42, an optical glass 44, and a plurality of engaging elements 45. The upper housing member 41 is connected pivotally and openably to the lower housing member 42, and includes a planar first top plate 411, a second top plate 410 connected to the first top plate 411, and a peripheral edge 412 surrounding the first and second top plates 411, 410. The lower housing member 42 includes a basin-like receiving portion 421 for receiving electronic components (such as drive circuits) which are connected electrically to the light-emitting modules 43, and a frame portion 422 connected to one side of the receiving portion 421. The frame portion 422 is formed with a frame opening 423. The peripheral edge 412 of the upper housing member 41 is connected pivotally to the frame portion 422 of the lower housing member 42 at one side thereof, so that the upper housing member 41 is pivotable relative to the lower housing member 42 to close or open the latter. Further, the upper housing member 41 is supported by the lower housing member 42. In this embodiment, the size and shape of the first top plate 411 of the upper housing member 41 correspond to that of the frame portion 422 of the lower housing portion 42. The second top plate 410 of the upper housing member 41 corresponds to the receiving portion 421 of the lower housing member 42.

A light post 401 is inserted into the receiving portion 421 of the lower housing member 42.

The engaging elements 45 are disposed on one side of the upper housing member 41 that is opposite to a pivot connection with the lower housing member 42. When the upper housing member 41 covers the lower housing member 42, through the engagement of the engaging elements 45 with the lower housing member 42, the upper housing member 41 can be maintained in a cover position relative to the lower housing member 42. Alternatively, the engaging elements 45 may be disposed on the lower housing member 42 and engaged to the upper housing member 41.

An optical glass 44 is disposed on the frame portion 422 of the lower housing member 42, and covers the frame opening 423.

Each light-emitting module 44 includes a circuit board 431, and a plurality of LED elements 432 disposed on the circuit board 431. The light-emitting modules 43 are disposed fixedly on a bottom surface of the first top plate 411 of the upper housing member 41, and face the frame opening 423, so that light from the LED elements 432 can directly pass through the optical glass 44 and out of the lower housing member 42.

From the aforesaid description, in the third preferred embodiment, the light-emitting modules 43 are disposed on the planar first top plate 411 of the upper housing member 41, so that heat generated by the light-emitting modules 43 can be transmitted to the first top plate 411 horizontally. Further, through the large area of the first top plate 411, a preferable heat dissipating effect of the present invention can be achieved. Thus, in the third preferred embodiment, preferably, the first top plate 411 has a heat-conductive material and a heat-conductive area, both of which are designed for conducting heat generated by the light-emitting modules along the first top plate 411.

In summary, by directly disposing the light-emitting modules 2, 33 on the central housing portion 11, 11' of the housing unit 1, 30, heat generated by the light-emitting modules 2, 33, 43 can be directly transmitted to the housing unit 1, 30. Further, as described in the first and second preferred embodiments, through the heat-dissipating fins 113 or the channel 310 formed in the housing unit 1, 30, heat dissipation performance of the housing unit 1, 30 can be enhanced.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An LED street light comprising:

a housing unit including a central housing portion made of a heat-conductive material, and two lateral housing portions disposed respectively on two opposite longitudinal sides of said central housing portion, said central housing portion including two spaced-apart sidewalls, each of said lateral housing portions including a first plate fixed to a respective one of said sidewalls, a second plate connected to and extending upwardly and slantingly from said first plate, a curved plate connected to and extending downwardly from said second plate, and a reflection layer disposed on said curved plate and facing one of said sidewalls, said first plate and said curved plate of each of said lateral housing portions having bottom ends defining a bottom opening, said first plate having a first plate opening; and a plurality of light-emitting modules disposed on each of said sidewalls, each of said light-emitting modules including at least one LED element, each of said light-emitting modules extending into one of said lateral housing portions through said first plate opening, said reflection layer reflecting the light emitted by said LED element toward said bottom opening.

2. The LED street light of claim 1, wherein said central housing portion further includes a top wall connected between said sidewalls, and a plurality of heat-dissipating fins connected integrally to and extending upwardly from said to wall.

3. The LED street light of claim 2, wherein said top wall has a vertical curved cross section, said heat-dissipating fins extending radially from said top wall.

4. The LED street light of claim 3, wherein said second plate of each of said lateral housing portions is in contact with an outermost one of said heat-dissipating fins.

5. The LED street light of claim 4, wherein said first plate and said curved plate of each of said lateral housing portions have bottom ends flush with bottom ends of said sidewalls.

6. The LED street light of claim 1, further comprising two optical glasses each connected to said bottom ends of said curved plate and said first plate of the respective one of said lateral housing portions and covering said bottom opening in the respective one of said lateral housing portions.

7. The LED street light of claim 1, wherein said housing unit further includes a connection member for insertion of a light post, said central housing portion being connected to said connection member.

* * * * *